United States Patent [19]

Tinklenberg

[11] 4,411,644

[45] Oct. 25, 1983

[54] METHOD AND APPARATUS FOR FORMING RECLOSABLE PACKAGES

[75] Inventor: Lloyd Tinklenberg, Worthington, Minn.

[73] Assignee: Bedford Industries, Inc., Worthington, Minn.

[21] Appl. No.: 223,408

[22] Filed: Jan. 8, 1981

Related U.S. Application Data

[63] Continuation-in-part of Ser. No. 112,542, Jan. 16, 1980, abandoned.

[51] Int. Cl.[3] ..... B31B 1/90

[52] U.S. Cl. ..... 493/213; 493/215; 493/927; 493/930

[58] Field of Search ..... 493/215, 214, 213, 212, 493/203, 223, 225, 226, 927, 923, 930

[56] References Cited

U.S. PATENT DOCUMENTS

| | | | |
|---|---|---|---|
| 3,418,891 | 12/1968 | Rivman et al. | 493/215 X |
| 3,845,695 | 11/1974 | Randazzo | 493/215 |
| 4,267,768 | 5/1981 | Cieslak et al. | 493/215 X |

*Primary Examiner*—James F. Coan
*Attorney, Agent, or Firm*—Robert C. Baker

[57] ABSTRACT

A payout coil of tape for forming substantially instantly openable and reclosable package closures over the flattened mouths of packages in mechanized packaging operations. The tape is a unified structure having a layer of solid non-tacky thermoplastic polymeric material. Optionally, the only layer of a tape may be a polymeric layer; and the polymeric layer may exhibit adhesive properties. Tapes with a backing are preferred, as are tapes which include a layer of adhesive activatable to tackiness at elevated temperatures and remaining tacky at temperatures lower than those at which the polymeric layer exhibits tackiness. The adhesive layer may be separately applied as a hot melt at the time of adhesively fixing the tape to a package. A tearstrip structure is integrally conjoined with and preferably embedded in the polymeric layer, and at least one deformable deadfold strip is also embedded in the polymeric layer. In the method and apparatus, tape is drawn from a coil toward a spaced alignment of flattened mouths of packages and adhesive is activated to tackiness before the tape is applied and bonded to the flattened mouths, whether the adhesive is a part of the tape or is separate from the coil of tape. The resulting package article is easily opened by the tearstrip and reclosed by deadfolding the projecting tape ends of the package.

7 Claims, 12 Drawing Figures

METHOD AND APPARATUS FOR FORMING RECLOSABLE PACKAGES

This application is a continuation-in-part of application Ser. No. 112,542 filed Jan. 16, 1980, and now abandoned.

This invention relates to improvements in packaging technology, and more particularly, to improved new packaging closure and reclosure tapes, especially in the form of payout coils thereof, to improved substantially instantly openable and reclosable packages, and to improved methods and apparatus for forming such packages.

Teachings of the invention are useful in the packaging of a variety of products, especially consumer products such as flour, sugar, coffee, snack foods, frozen foods, cereals, cheeses, pet foods, tobacco, salt pellets, and many others. The closure tapes hereof are useful to form reasonably tight seals or closures to insure product freshness or minimize product contamination as well as to prevent tampering or pilferage during shipment and store display. The closures are substantially instantly openable or rupturable. Nevertheless, they provide for easy reclosure of the package for further storage of unused contents after removal of a portion thereof. These benefits are accomplished in an exceedingly simple manner, with tapes of modest total mass and great economy of structure and material. They add little to the bulk or body of a total package and may be applied to packages with mechanized high speed efficiency.

Incorporated herein and made a part hereof, in summary of the teachings of this invention, are all claims appended below.

The invention will further be described by reference to a drawing made a part hereof wherein.

Figure 1:
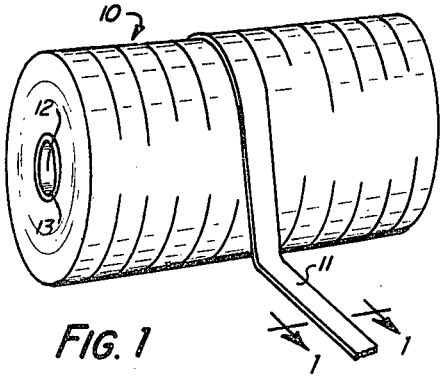
FIG. 1 is a schematic perspective view of a payout coil of tape according to this invention.

Referring to FIG. 1, the coil 10 essentially consists of a spiralling of the new packaging tape 11. The tape is wound in layers upon itself by traversing it back and forth to form a level or even winding about a central opening 12 capable of receiving a shaft on which the coil is mounted for payout in packaging operations. If desired the tape may be coiled upon a thin sleeve or core member 13 of disposable material. Also, if desired, the core member 13 may optionally have end flanges (not shown). The coil or winding 10 suitably may be characterized as being in reel form.

In each tape of FIGS. 2–9, layer 14 comprises or may consist of thermoplastic polymeric material. The polymeric material is non-tacky at normal environmental or ambient temperatures and is normally solid as distinct from being flowable at such temperatures.

As used herein "polymeric material" refers to polymerized products whether formed using one monomer or a multitude or mixture of monomers, and includes the possibility of more than one type of polymer in admixture. Polyvinyl acetate and polyethylene are especially useful economical polymeric materials, but other known thermoplastic polymers also satisfy the criteria expressed herein for the polymeric material. The polymeric layer may be looked upon as a bonding or bodying layer of the tape.

Figure 2:
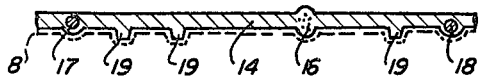
FIGS. 2 through 9 are schematic transverse cross-sectional views of illustrative tape structures of the invention, with dash lines used to illustrate optional layers; all cross-sections are taken at 1—1 of FIG. 1.
Figure 7:
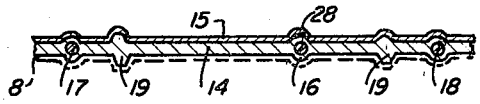
Figure 3:
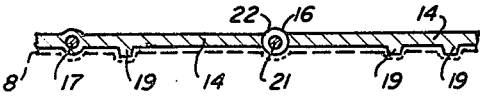
Figure 8:
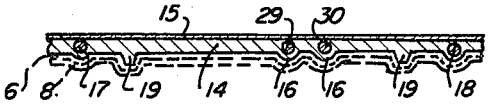
Figure 4:
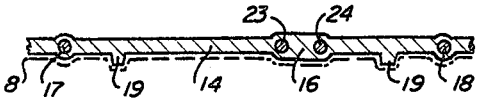
Figure 9:
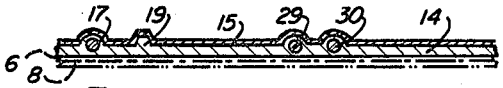
Figure 5:
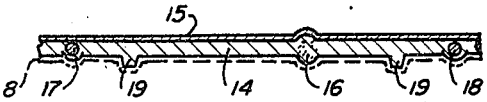

The tapes of FIGS. 2, 3 and 4 are termed "backless" because they do not have a special backing layer. Those of FIGS. 5 through 9, inclusive, have a backing layer 15. All tapes of FIGS. 2–9 may have an optional layer 8 which is characterized as being the active adhesive layer. The adhesive of layer 8 is most preferably one that is normally non-tacky and thermoplastic, as well as one which is activatable to a usefully aggressive tackly adhesive state at relatively lower elevated temperatures than those required to generate useful tackiness in the polymeric layer. Additionally, the preferred thermoplastic adhesives for layer 8 are such that they retain their tacky state for at least some period of time—at least a few seconds—even after falling to a temperature below that employed for initial activation of them. Sometimes a further layer 6 may be employed in any or all of the tape structures; and such layer 6 is illustrated in FIGS. 8 and 9. Layer 6 may function as an intermediate primer or unifying layer between adhesive layer 8 and polymeric layer 14. In many instances, however, suitable unification of the active adhesive layer 8 to layer 14 may rely upon constituents common to both layers, such as, for example, a polymer such as polyvinyl acetate present in both the polymeric and adhesive layers. Paper or other thin fibrous sheet or film is useful as a unifying layer 6, with the thermoplastic materials of layers 14 and 8 suitably mechanically interlocked with the fibers of the thin sheet by applying heat and pressure to the laminate. All layers of the tapes extend to each lateral edge of the tape.

As used herein, the "body means" of tapes refers to the mass of the layers of the tapes apart from their tear and deadfold strips. Thus, the body mass of the tapes of FIGS. 2, 3 and 4 consists of the polymeric layer 14, plus any optional adhesive layer 8. Both such layers characteristically can be activated to tackiness by heat, but layer 8 is preferably activatable to that state at lower temperatures than layer 14 and exhibits the greater aggressive tack for high speed packaging. Thus, thermoplastic adhesives can be used in forming the polymeric layer 14 as well as layer 8. Such adhesives contain polymeric materials. Layers 14 and also 8 may be homogeneous or include various mixtures of materials, including plasticizers or other modifiers for altering the temperature of heat activation or for enhancing tackiness on heating. Also, dyes, pigments or other coloring additives may desirably be employed to enhance visual distinctions between elements or match the color of the main part of a package. Useful materials for layer 8, and also layer 14, include resinous materials such as, for example, polyvinyl acetate, whether polymerized by itself or with other monomers, polyethylenes especially of low density, rubbery materials such as, for example, natural or synthetic rubbers cast from latex form, polyurethanes, protein base materials such as, for example, casein, or a variety of other materials in formulations now known or hereafter developed. Hot melt adhesive formulations are especially useful as heat-activatable non-tacky adhesives, and are conveniently applied as a separate step at the time of fixing the tape to packages, as discussed below. Even thermosettable, but non-thermoset, adhesive formulations may be used as heat activatable normally non-tacky adhesives. Suitable adhesive formulations are those of the film forming type, and are of organic character, or organic plastics character. They are polymeric. Together, layers 14 and 8 comprise a laminate of different adhesive materials. The essence of this invention does not lie in the specific formulations employed but in the structural form and characteristics of the layers and the relationships between features and elements of the structure.

For example, known mixtures of indene resin and ethyl cellulose with a latent crystalline plasticizer such as diphenyl phthalate are non-tacky at normal temperatures but activatable to tackiness at temperatures as low as 60° C. and exhibit tack for a period of time after cooling. Thermoplastic polymeric condensation products of ethylene glycol and sebasic acid are known which develop tack in the range of 95° to 120° C. Polyethylene, however, usually requires temperatures well above 120° C. and even above 150° C. for the development of tack. These and other materials are well known to adhesive experts who readily can formulate to satisfy the criteria herein discussed for the layers 14 and 8. Preferably, activation of layer 8 to an aggressive tacky state occurs at a temperature at least 20° C. lower than that required for the activation of the composition chosen for layer 14 to a comparable state. Specific adhesive formulations for practicing the invention also may vary according to the specific adhesion needed for adherence to a base packaging material, which is a general concept well known to adhesive experts.

Useful base packaging materials for forming packages (e.g. bags, envelopes, cartons, and the like) are extremely varied, and include paper or other fibrous sheet material, various films such as cellophane, polypropylene, polyethylene of both high and low density, glassine, various metal foils, polyethylene terephthalate ("Mylar"), nylon, woven and non-woven sheet materials, and others. The base package may be formed by using a single homogeneous film or sheet or by using laminated sheet structures. At least the mouth portion of the package is sufficiently flexible or hinged so as to be flattenable.

The backing layer 15 of the tape structures of FIGS. 5 through 9, inclusive, is considered non-adhesive as compared to the layer 14 thereof. Stated another way, the backing 15 does not become adhesive or tacky under the conditions for achieving tackiness in layer 14. Many backing materials are useful, including fibrous backings, for example, paper; non-fibrous films, for example, cellophane, glassine, polyethylene terephthate ("Mylar"), nylon; metal foils, for example, aluminum or tin; woven materials; non-woven webs of filaments; and others. Generally a backing selection is made to conform to the material or appearance of the base package for which a tape is to be employed as a closure, but intentional variation from the material of the base package is sometimes desirable to dramatize the location and features of the closure tape.

Extremely thin backings are most preferred. Non-tough easily rupturable backing films or sheets or layers are most useful; and paper backings, especially tissue thin ones, are especially useful. Relatively tough materials also may be used. Stretched films of polymers, biaxially oriented, especially polyester films, are useful. If tough materials are used, they preferably should either be sufficiently thin or possess a tear weakness so as to be rupturable by the tearstrip, or be scored along lines adjacent the tearstrip structure.

In many preferred structures, the layer 14 is greater in mass than the backing and therefore dominates. As regards the tape body mass (i.e., the layers but excluding tear and deadfold strips), a cross section through the backed tapes preferably has a greater area (over 50%) occupied by layer 14 than by backing material. Indeed, the layer 14 may account for over two thirds of the body mass area of a cross section, and even over 75% or more, including as much as 90% or 95%. In some cases, however, it may account for as little as about 10% or 20% of a cross section through the tape body mass. This mass or thickness relationship between layer 14 and backing 15 is equally variable where layer 14 is per se employed as the adhesive layer. Illustratively, the high adhesive character of the layer may permit such a small amount to be used that a backing is needed to carry it and will dominate in mass over the layer 14. Sometimes an optional layer 8 of adhesive may exhibit such aggressive tack on activation that an extremely small amount is all that is necessary; and the adhesive may be carried by a paper backing 6 which itself is laminated to layer 14 by heat and pressure, using a release or low adhesion surface to apply the pressure.

Backed tapes are mostly employed where the particular mechanized closure machinery for applying the tape in closure over the mouth of a package is equipped with heated plattens or adhesive activation elements which are not only designed to contact the backing but have a character which would become adhesive contaminated but for a non-adhesive backing. Also, backings are particularly useful when the adhesive selected for the tape is of the normally tacky pressure-sensitive type. Normally tacky pressure-sensitive adhesives are well known; and among the most aggressive are those of the acrylate family (e.g., isoamyl acrylate copolymerized with acrylic acid). Most preferably, however, the adhesive for backed tapes is heat activatable and normally non-tacky.

All tapes of the invention have an elongated tough tearstrip structure 16 unified or integrally conjoined with the layer 14. The structure is removable and disposable and preferably is such as to be essentially non-hazardous or safe to use. Non-metallic tearstrips which are readily degradable, even organic ones which are bio-degradable, are desirable. For reliability and strength in accomplishing tear separation, however, metal wire (aluminum, iron, tin, and the like), preferably malleable or ductile, is useful. Flexible filaments of glass, thread, cord or the like may comprise the tearstrip structure. The tearstrip is not merely laid upon any adhesive layer; it is joined or unified with the polymeric layer 14, even to the extent of being an integral part of it. Indeed, the elongated tough tearstrip member is most preferably embedded in layer 14. This contributes to simplicity of structure and yet gives a functionally useful product even when additional lower layers such as layer 8 are employed. The interesting tearstrip at 16 of FIGS. 2 and 5 consists of a longitudinal rib or ridge or bead (i.e., a thickened part) of layer 14; it may consist of a different thermoplastic polymer from other portions of layer 14. In form, it is a thickening of layer 14, projecting outwardly from either or both surfaces (face and rear) of the layer. In the drawing, the lower surface of each tape of FIGS. 2 through 9 is the face surface exposed for sealing the same to the outside of opposing walls of the flattened mouth of a package.

The tearstrip structure is located in the tape at an intermediate part of the tape between the side edges. It need not be located exactly in the center between edges of the tape, and preferably is not, but is at least more toward the central or middle portion than the lateral side portions of the tape. Most preferably it is off-center, but is at least located in the mid-portion (intermediate portion) between the side edges. It extends as a straight structure throughout the length of the tape, and has a tensile strength at least greater than the tear strength of the tape body mass located immediately adjacent to the tearstrip structure. Functionally, the tearstrip structure, on pulling of it in a direction perpendicularly outward from the tape following adhesive affixation of the tape as a closure, causes a longitudinal ripping of the tape along a line or lines at or adjacent the location of the tearstrip structure. The ripping may effect complete severance of the tape into lateral parts, or it may provide a line of weakened structure easily separated by pulling on lateral sides.

In most tapes, the outside appearance of tearstrip structure at the rear or back surface of the tape opposite that affixed to a package is visually distinct from lateral parts of the tape immediately adjacent thereto. This is especially apparent after the tape is affixed as a closure. The visual distinction may arise solely from a beading or ribbing of the tearstrip structure outwardly at the rear or back surface. It may arise from a color distinction or an opacity or transparency or translucency distinction between the tearstrip structure and tape areas adjacent thereto. For example, the tearstrip structure may be relatively more opaque or less translucent than areas adjacent thereto, or strongly white or green as compared to adjacent areas of less intense color (or adjacent areas which are fully transparent or a different color). This visual distinction for the tearstrip structure facilitates consumer recognition of it, and effective functional use of it to open a package.

Figure 6:
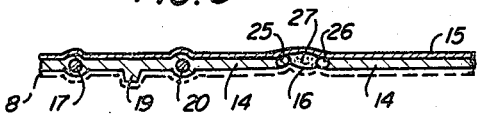

An essential element of the tape is at least one deadfold strip 17, generally a round wire of ductile or malleable metal, or at least one lacking memory. Spring wire is not useful. Wires of tin or ductile iron or aluminum are preferred, but other known deadfold materials may be used, if desired. The deadfold strip extends as a straight longitudinal member throughout the length of the tape and is embedded in the main tape body mass. In the tapes of FIGS. 2, 3 and 4, the deadfold strip 17 is embedded in material of layer 14. It is at least substantially embedded in the material of layer 14 of the tapes shown in FIGS. 5 through 9; and may be at a location substantially proximate or even adjacent to the inner side of the backing layer of those tapes. Functionally, deadfold strips serve to hold the tape in a folded condition for reclosure of a package. Preferably at least two or even three or four such deadfold strips or wires are employed for this purpose. In the most preferred structures at least one deadfold strip is on each side of the tearstrip. The second deadfold strip 18 in the tapes of FIGS. 2, 4, 5, 7, and 8 is on the side of the tearstrip opposite the side containing the main or first deadfold strip 17. In such structures, each lateral side of the tape includes a deadfold strip after removal of the tearstrip structure; and thus, each lateral side strip of tape is useful for reclosure purposes. While equal spacing of the deadfold strips on opposite sides of the tearstrip is possible, unequal spacing is preferred. One deadfold strip preferably should be closer to the tearstrip than the other to facilitate the formation of relatively flatter closures of the type illustrated in FIGS. 10 and 11. In some instances, as illustrated in FIG. 6, it may be desirable to place a second deadfold strip 20 between the main or first deadfold strip 17 and the tearstrip 16.

A preferred feature is that of one or more special longitudinal ridges or ribs 19 of adhesive material. The ribs 19 may be various located, but are preferrably located proximate to, but spaced from, the deadfold strips of the tapes. Functionally, they contribute to adhesive affixation of the tape upon a package, especially at their longitudinal line near the deadfold strips; and they are especially effective for this purpose under conditions of high speed mechanized packaging.

All tape structures are characterized by a "profile" in cross section which includes longitudinally extending elements or ribs which project outwardly from the otherwise essentially flat mass of the tape. In the most preferred structures, the rib projections, whether mainly of adhesive material or including a deadfold strip (or a core tearstrip), are outwardly from the face surface of the tape designed for adhesive attachment to form a package closure. Even rib projections containing a deadfold strip are preferably or suitably on the face side to be adhesively fixed to a package. Further the rib projections containing a deadfold strip suitably have exposed adhesive for attachment to a package. In mechanized packaging operations, a sufficient quantity of adhesive is needed for sealing even when the tape structures, as regards their body mass, are otherwise extremely thin and add little to the bulk of a package. Optionally, however, rib projections from the rear or back side of the tape may be employed, or from both sides, as variously illustrated in the drawing. Such rib projections additionally may be used as elements for controlling the alignment of the tape in automatic packaging.

Some further variations of tearstrip structures will now be discussed. In FIG. 3, tearstrip 16 comprises a substantially non-elastic non-adhesive core element or filament 21 (for example, one of metal wire, or a cotton thread, or an organic filament such as one of nylon, or a polyester such as polyethylene terephalate) having a further non-adhesive film-forming organic plastics coating 22. Where a relatively low temperature tackifies a polyvinyl acetate adhesive formulation employed as layer 14, a high density thermoplasic, e.g., polyethylene, may function as a coating 22 since it is not tackified under the lower temperature conditions for activation of the polyvinyl acetate formulation. Further, the layer 14 may extend outwardly from the composite tearstrip structure 21 and 22 without encircling that tearstrip structure, although the elongated tearstrip member 21 is encircled or embedded by the thermoplastic 22. An advantage for the structure just described is that it is essentially impossible to accidentally transfer adhesive from the tearstrip area directly into the flattened mouth of a package even when liberal tolerances are employed in automatic packaging. However, if desired, the coating 22 of FIG. 3 may consist of a heat activatable adhesive of either the same or a different character from that in the layer 14.

In FIG. 4, the tearstrip comprises two cores 33 and 24 (suitably of wire or thread or filament) in proximate parallel relationship. They are surrounded by material of the layer 14. Two such elongated core members in the tearstrip structure contribute to effective full separation of the tape into lateral parts at the time the tearstrip structure is pulled from the tape on a package. FIG. 6 also illustrates two such cores 25 and 26, with relatively non-adhesive material 27 extending between and uniting them, but with the material of layer 14 extending laterally outwardly therefrom without encircling the tearstrip structure. The tearstrip of FIG. 7 consists of a single core 28 substantially embedded in layer 14 at a location proximate to backing 15. In FIG. 8, the tearstrip consists of two such core members 29 and 30 in proximate parallel relationship but with a discrete ridge profile for each, and with each core member substantially embedded in the material of layer 14 forming its ridge and located proximate to backing 15. In FIG. 9, the tearstrip is comparable to FIG. 8, except that the profile of ridges is reversed from those in FIG. 8, so that the face or lower surface of FIG. 9 is relatively flat for sealing to the mouth of a package.

Manufacture of these tapes may be conveniently accomplished by casting of solutions or dispersions of the adhesive on a grooved surface with simultaneous placement of the deadfold strips and tear structure, or by a two step casting process with the deadfold and a tear element emplaced between the casting steps. Subsequent altered profiling of the tape, if desired, may be accomplished by passing it between a pair of heated grooved rollers. Hot melt thermoplastic polymers or adhesive formulations may be converted to tape form, and appropriate profiling simultaneously accomplished, by passing the hot melt with the deadfold and any tear core strips through the nip of cooled grooved rollers. Backings if employed, may be added as the base for casting or may be introduced and united to the structure at the time of passing it between grooved rollers. A variety of known techniques for tape manufacture may be employed. As aforenoted, the optional adhesive layer 8 may be omitted at the time of tape manufacture and applied as a coating either to the tape or to packages to be sealed at the time of forming reclosable packages with the tape.

Tape structures of the invention may be as narrow in width as approximately one half centimeter, or as wide as even 4 or 5 centimeters, or even greater, if desired. For most applications, they need not be wider than about 2 or possibly 3 or 4 centimeters, and are at least about one centimeter in width. They may possibly be as thin as about 10 microns (0.01 millimeter; 0.0004 inch) in non-ribbed or flat parts, or as thick as about one or two millimeters, or slightly more, in those parts. Generally for most small packaging, they will be between about 0.05 and 0.5 millimeters (between about 50 and 500 microns) thick in non-ribbed parts, with the ribbed parts usually at least approximately twice as thick, up to about three or even four times as thick, as the non-ribbed parts. Ribbed parts such as adhesive ridges 19 may be only about 30% greater than the thickness of non-ribbed parts, but even those adhesive ribs or ridges 19 are preferably at least about twice the thickness of non-ribbed parts of thin tapes for most reliable application of the tape to packages.

A tape structure having the profile shown in FIG. 2, and lacking optional layer 8, may be formed using a heat activatable polyethylene adhesive layer 14 and 500 micron diameter (24 gauge) tin wires as the deadfold strips 17 and 18. The tape may illustratively be about 0.9 centimeters wide. Its layer of adhesive may in non-ribbed parts be 600 microns thick. Its deadfold strips are placed approximately one millimeter from its side edges; and its tearstrip structure of 1500 microns thick adhesive is suitably located approximately 0.5 millimeters from one edge and about 0.4 millimeters from the other. The tearstrip may be pigmented white, with other parts translucent. Such a structure is suitably applied to a package by the use of heated plattens coated with anti-stick surfacing such as polytetrafluoroethylene.

The tape of, for example, FIG. 8 (without optional layers 6 and 8) may be formed using a thermoplastic polymeric polyvinyl acetate adhesive formulation as layer 14 at about 500 microns thickness in non-ribbed parts. Deadfold strips 17 and 18 may be round tin wires of about 500 microns diameter. Tear elements 29 and 30 may comprise polyester filaments about 250 microns in diameter embedded in ribbed adhesive; but most preferably the elongated tear members 29 and 30 are metal wires. Aluminum wires of about 400 or 500 microns diameter are useful. The backing 15 may consist of tissue thin Kraft paper.

Figure 10:
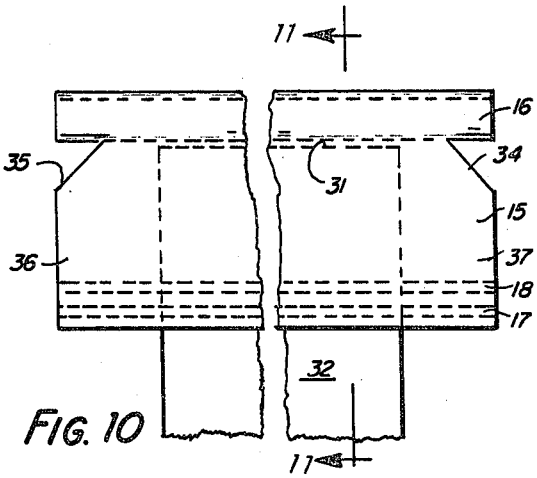
FIG. 10 is schematic plan view, partially broken away, of the side of a package closed with a new closure tape of this invention.
Figure 11:
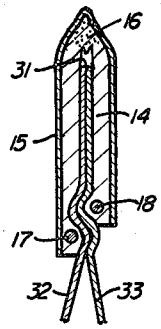
FIG. 11 is a schematic sectional view, partially broken away, taken along line 11—11 of FIG. 10.

In FIGS. 10 and 11, a tape of the invention is applied as the closure over the flattened mouth 31 of a package. The package suitably may be a bag of glassine or paper or other suitable material. The mouth may be defined simply by two sides 32 and 33 of the bag. The two sides may simply be pressed together in face to face relationship at the mouth to form a flattened mouth; or the sides may be pleated and then flattened together. (If desired, the face to face sides of the bag just inside the mouth may weakly be sealed together along a line which is easily ruptured at a later time by simply pulling the sides apart.) Over the flattened mouth 31 is secured a length of the tape (illustratively, the tape of FIG. 5) with its tearstrip 16 in alignment over the termination of the opposing walls 32 and 33 at the flattened mouth 31, and with lateral portions of the tape (i.e., those on opposite sides of the tearstrip structure 16) folded over the mouth and adhesively fixed to the outside of the opposing walls 32 and 33 adjacent the mouth 31. The folded tape itself extends or projects beyond both ends of the flattened mouth 31; and the tape lateral sides as folded at the projecting ends 36 and 37 are sealed together. At least one projecting end of the tape is preferably cut to form a notch 34 into the tape adjacent the tearstrip 16. This enhances ease of gripping tearstrip 16 and pulling it outwardly to sever or rip the tape and permit opening of the mouth 31. A second notch 35 may be cut at the opposite projecting end of the tape.

Reclosure of a tearstrip opened bag structure is conveniently accomplished by again flattening the mouth, folding it downwardly over itself once or twice (which simultaneously effects a rolling or folding of the tearstripfree tape structure itself since it is fixed on the sides of the mouth), and then bending the end projections of the tape over the folded reclosure. The deadfold strips of the tape are thus folded over the folded reclosure and retain it in that condition.

Figure 12:
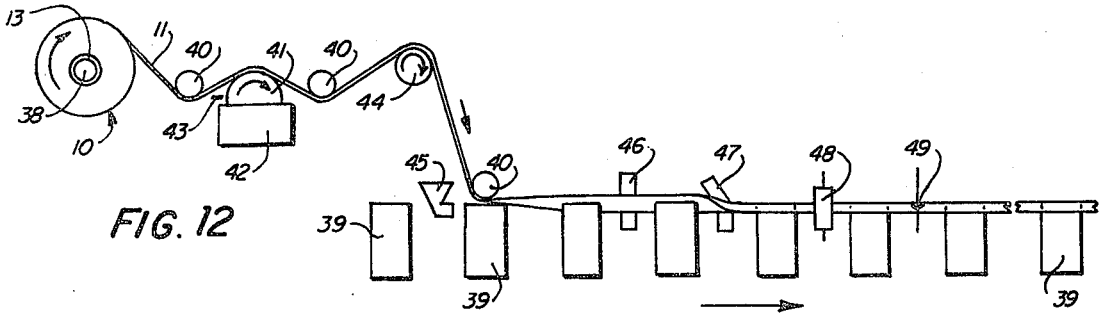
FIG. 12 is a schematic side view of apparatus for practicing method teachings of the invention.

For automatic packaging according to the invention, as illustrated in FIG. 12, a payout coil 10 of the tape is mounted on a shaft 38 for tape payout. Packages 39 with their mouths flattened (uppermost part) are conveyed in spaced relationship with their flattened mouths in lengthwise relationship and in alignment along a line. Tape 11 is drawn from the tape payout coil toward the line of flattened mouths.

Interposed between the payout coil and the line of flattened mouths are suitable guide rollers or bars 40, as required for controlling the movement of the tape. Where the tape lacks a rapidly heat activatable adhesive layer (e.g., lacks a layer 8 of lower activation temperature as discussed for FIGS. 2–9), a suitable activated adhesive layer may be added to the tape by a hot melt applicator. Illustratively, such an applicator may consist of a rotatable cylinder 41 partially submerged in a hot melt tack 42. A Doctor blade 43 or other means is suitably employed to regulate the quantity of adhesive applied to the tape 11. The tape may be drawn over a freely rotating heating drum 44 having a low adhesion or release coated surface, for example, a silicone or polytetrafluroethylene coated surface to which the hot melt adhesive on the tape does not exhibit adherence. Such a heated drum 44, or a series of the same, may be used to activate a polymeric adhesive layer 14 or a rapidly activatable adhesive layer 8 of a tape, or may be used to maintain a hot melt applied adhesive layer at a desired temperature for a tacky condition. Instead of applying a hot melt adhesive directly to tapes not equipped with a quickly tackified adhesive layer, one may employ an applicator means 45 to apply a hot melt adhesive to opposite sides of the flattened mouths of packages as they are conveyed along by any suitable conveyor means. The packages 39 are suitably conveyed at rates of speed effective to cause sealing of about 100 packages a minute, or faster, making it necessary to employ hot melt adhesives or to employ an adhesive layer, such as layer 8, which is activatable at relatively low elevated temperatures quickly reached.

After activation of adhesive, the tape is drawn with the tearstrip structure of the tape in alignment along the line of the flattened mouths, as by powered rollers 48 or the like.

Where the tape is mounted on a horizontal shaft as distinct from a vertical one, and where the sides of the flattened package mouths are oriented vertically, as illustrated, the tape must be shifted to a vertical orientation by a guide control member 46 or any equivalent means. Control member 46 may comprise a vertically oriented freely rotatable shaft which functions to tilt the tape to the vertical while maintaining the tearstrip of the tape in alignment along the line of flattened mouths. Additionally, control member 46, or a separate roller or pressure element, suitably functions to press at least one lateral portion of the tape into at least a temporarily bonded condition against at least one of the opposing walls of packages 39 adjacent their flattened mouths during conveyor movement of packages 39. (Both lateral portions on each side of the tearstrip of a tape may be sealed to a package in one pass where the flattened mouth is folded over one side of the package so that both sides of the package adjacent the flattened mouth lie in substantially the same plane.) Thereafter, folding means 47, or a contoured sheet of metal, functions to fold the tape over the flattened mouths as the conveyor for the packages 39 and rollers 48 draw the tape along. Once folded, coacting powered pressure rollers 48 or equivalent means on opposite sides of the line of packages press the lateral portions of the tape into firmly bonded or secured condition onto the opposite sides or walls of the package adjacent the flattened mouths. Also, lateral portions of the tape on opposite sides of the tearstrip are bonded to themselves in spaces between the mouths. The tearstrip remains in alignment along the line of the flattened mouths during these steps. If desired, rollers 48 may be heated and coated with polytetrafluoroethylene or other release or antistick surface; such a surface is particularly important where the rollers are heated and the tape employed lacks a non-adhesive backing. A transverse cut is made through the portions of the tape between, and spaced from, those portions of the tape adhesively fixed to the flattened mouths. A reciprocating cutting means 49 performs this function. This leaves each package with end segments of tape projecting away from the sealed portion at the mouth of the package. At the same time transverse cutting is accomplished, it is convenient to notch projecting ends of the tape adjacent the tearstrip to facilitate easy gripping of an end of the tearstrip for removal of it.

That which is claimed is:

1. The method of forming substantially instantly openable and reclosable packages having opposing walls terminating at an openable but flattened mouth at which said opposing walls are in substantially face to face relationship, comprising:

(a) mounting a coil of tape on a shaft for payout of said tape from said coil, said tape having a body mass comprising a layer of non-tacky thermoplastic polymeric material, an elongated tearstrip member embedded in said polymeric layer at a location intermediately between the side edges of said tape and extending as a straight longitudinal member throughout the length of said tape, said tearstrip member having a greater tensile strength than said body mass of said tape, and at least one deadfold strip embedded in said polymeric layer at a location between said tearstrip member and one lateral edge of said tape and extending as a longitudinal strip in said tape, (b) flattening the mouths of packages and moving the flattened mouths in lengthwise spaced relationship along a line, (c) drawing said tape from said coil toward said line of flattened mouths, (d) activating to tackiness a normally non-tacky thermoplastic adhesive in preparation for bonding said tape to said flattened mouths, (e) then applying and bonding lateral portions of said tape to the outside of opposing walls of said packages adjacent said flattened mouths with said activated thermoplastic adhesive as the bonding material and with said tearstrip structure of said tape aligned along the line of said flattened mouths, and (f) transversely cutting said tape at locations spaced from portions of said tape bonded to said packages.

2. The method of claim 1 wherein said tape comprises said thermoplastic adhesive and wherein said step of activation of said thermoplastic adhesive comprises subjecting at least said thermoplastic adhesive portion of said tape to heat.

3. The method of claim 1 wherein said thermoplastic adhesive is separate from said coil of tape and said activation of said thermoplastic adhesive comprises melting the same.

4. The method of claim 1 additionally comprising notching at least one of the cut projecting ends of said tape bonded to said packages, said notching being at a location adjacent the tearstrip member of said tape.

5. The method of claim 1 wherein said tape additionally comprises an outwardly projecting longitudinal rib of non-tacky thermoplastic material activatable by heat to a tacky state, and wherein said rib is substantially flattened during said step of bonding said tape to said packages.

6. Apparatus for forming substantially instantly openable and reclosable packages having opposite walls terminating at an openable but flattened mouth at which said opposing walls are in substantially face to face relationship, comprising:

(a) tape payout means including a coil of tape on a shaft for payout of said tape from said coil, said tape comprising a thermoplastic layer, a tearstrip structure fixed intermediately between the side edges of said tape and extending as a longitudinal structure in said tape, and at least one deadfold strip fixed at a location between said tearstrip structure and one lateral edge of said tape and extending as a longitudinal strip in said tape, (b) conveyor means for moving said flattened mouths of packages in spaced relationship with the flattened mouths in lengthwise relationship along a line, (c) means for drawing said tape from said tape payout means over said flattened mouths with said tearstrip structure of said tape in alignment along the line of said flattened mouths, (d) means for separately applying hot-melt adhesive for adhesively fixing the lateral portions of said tape on opposite sides of said tearstrip structure to the outside of said opposing walls of said packages adjacent said flattened mouths, and (e) means for transversely cutting through portions of said tape between and in spaced relationship from those portions of said tape adhesively fixed to opposing walls of said flattened mouths.

7. The apparatus of claim 6 additionally comprising means for notching at least one projecting end of tape on said flattened mouths at a location adjacent the tearstrip structure of said tape.

* * * * *